United States Patent [19]

Knudsen

[11] 4,073,238

[45] Feb. 14, 1978

[54] POWER AND FREE CONVEYOR WITH ENGAGING MEANS OPERABLE ON VERTICALLY CURVED SECTIONS OF TRACK

[75] Inventor: Kenneth F. Knudsen, St. Clair Shores, Mich.

[73] Assignee: American Chain & Cable Company, Inc., Bridgeport, Conn.

[21] Appl. No.: 696,576

[22] Filed: June 16, 1976

[51] Int. Cl.[2] ..... B61B 10/00

[52] U.S. Cl. ..... 104/172 S; 104/172 C

[58] Field of Search ..... 104/172 R, 172 C, 172 S, 104/178

[56] References Cited

U.S. PATENT DOCUMENTS

| | | | |
|---|---|---|---|
| 3,354,834 | 11/1967 | Orwin | 104/172 S |
| 3,559,586 | 2/1971 | Follrath | 104/172 S |
| 3,726,233 | 4/1973 | Swartz | 104/172 S |
| 3,741,126 | 6/1973 | Ross | 104/172 S |

FOREIGN PATENT DOCUMENTS

| | | | |
|---|---|---|---|
| 808,402 | 3/1969 | Canada | 104/172 S |
| 801,898 | 9/1958 | United Kingdom | 104/172 S |
| 1,373,759 | 11/1974 | United Kingdom | 104/172 S |

*Primary Examiner*—Johnny D. Cherry
*Assistant Examiner*—Carl Rowold
*Attorney, Agent, or Firm*—Barnes, Kisselle, Raisch & Choate

[57] ABSTRACT

A conveyor system comprising a conveyor track, a conveyor movable along said track, a free track and a plurality of carriers movable along the free track. The conveyor has longitudinally spaced pusher and holdback dogs mounted thereon. Each carrier comprises spaced trolleys, and tie bar means interconnecting the trolleys. A trailing trolley has a pusher movably mounted thereon for movement into and out of the path of the pusher and holdback dogs. A bumper is mounted on the carrier at the front end thereof and is adapted to engage a preceding carrier or an obstacle. Means interconnect the bumper and the retractable pusher such that upon engagement of the bumper with the preceding carrier or obstacle the pusher is retracted out of the path of the pusher dog. The arrangement is such that the trolleys can pivot horizontally and vertically with respect to the means interconnecting the trolleys so that the system will function with horizontally and vertically curved tracks.

24 Claims, 9 Drawing Figures

POWER AND FREE CONVEYOR WITH ENGAGING MEANS OPERABLE ON VERTICALLY CURVED SECTIONS OF TRACK

This invention relates to conveyor systems and particularly to power and free conveyor systems.

BACKGROUND OF THE INVENTION

In power and free conveyor systems, it has long been known that the carriers which are movable along a carrier or free track can be disconnected from driving engagement with the conveyor that is movable on the conveyor track by various means. Where the pusher dog is on the carriers and the pusher is on the conveyor, means may be provided on the carrier such that when the carrier engages an obstacle or a preceding carrier, the pusher dog on the carrier is moved out of the path of the pusher on the conveyor. Where the holdback and pusher dogs are pivoted about longitudinally extending axes on the conveyor and the pusher is on the carrier, the problem of accumulation has been approached by providing means along the track for deflecting the pusher and holdback dogs out of the path of the pusher on the carrier. It has also been heretofore suggested that a cam on the carrier be provided for moving the dogs on the conveyor so that they do not engage the pusher on the carrier. however, where the carrier comprises a plurality of trolleys and the pusher is on a trailing trolley, such an arrangement is not suitable.

It has also been heretofore suggested to provide means interconnecting a bumper and the pusher to retract the pusher upon engagement with an obstacle or a preceding carrier. However, such an arrangement also may cause retraction upon relative movement between said trolley and said tie bar means interconnecting the trolleys.

Accordingly, among the objects of the invention are to provide a system wherein a carrier having a plurality of trolleys with the pusher on a trailing trolley may be readily disconnectable from driving engagement with the conveyor upon engagement with an obstacle or a preceding carrier; which system is dependable and which will function effectively upon horizontally or vertically curved track sections.

SUMMARY OF THE INVENTION

In accordance with the invention, the conveyor system comprises a conveyor track, a conveyor movable along said track, a free track, a plurality of carriers movable along the free track. The conveyor has longitudinally spaced pusher dogs mounted thereon. Each carrier comprises spaced trolleys and tie bar means interconnecting the trolleys. A trailing trolley has said pusher movably mounted thereon for movement into and out of the path of the pusher dogs. A bumper is mounted on said carrier at the front end thereof and is adapted to engage a preceding carrier or an obstacle, and means interconnect the bumper and the retractable pusher such that upon engagement of the bumper with the preceding carrier or obstacle the pusher is retracted out of the path of the pusher and holdback dogs. The arrangement is such that the trolleys can pivot horizontally and vertically with respect to the tie bar means interconnecting the trolleys so that the system will function with horizontally and vertically curved tracks.

DESCRIPTION

Figure 1:
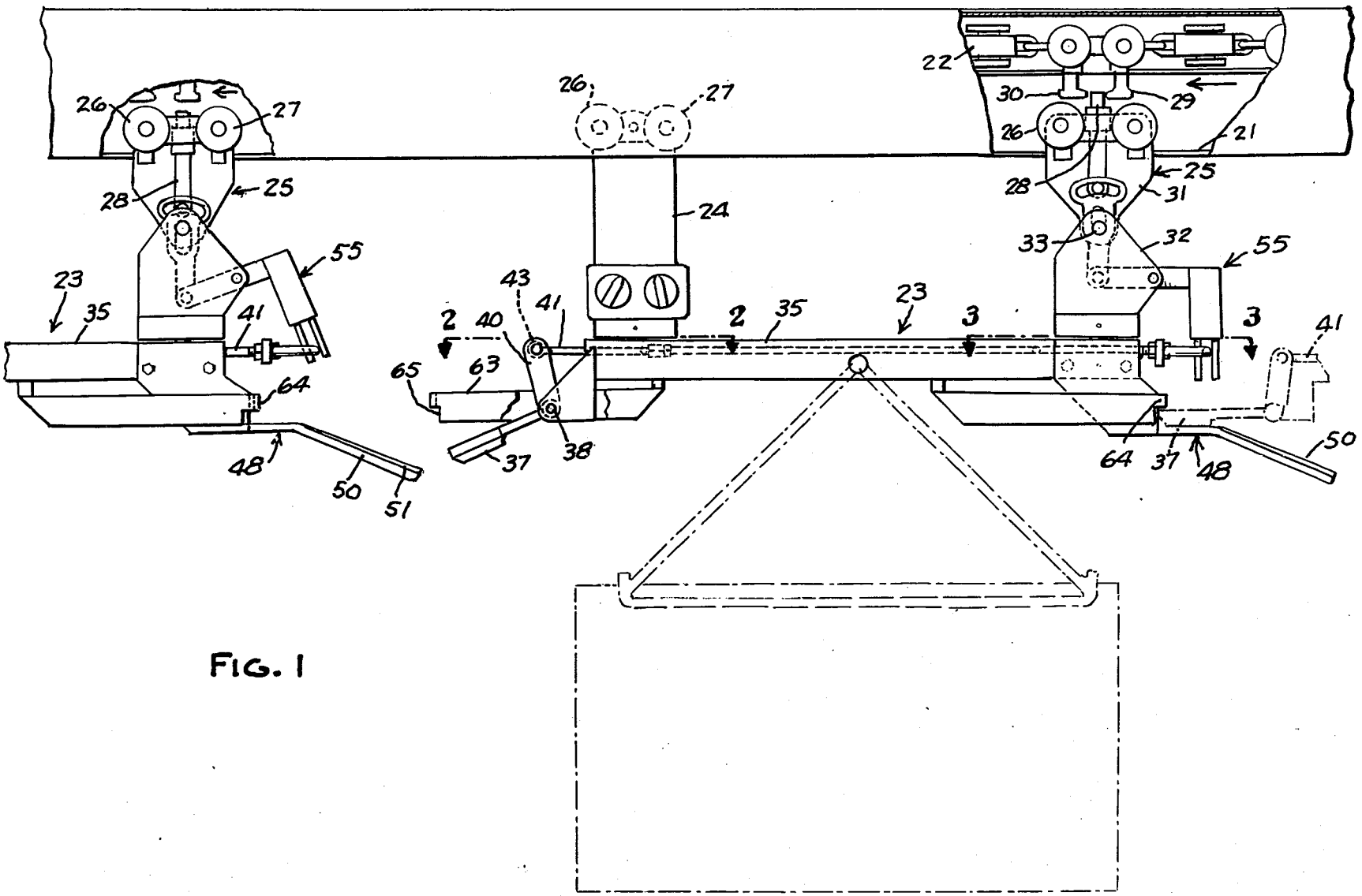
FIG. 1 is a part sectional side elevational view of a conveyor system embodying the invention.

Referring to FIG. 1, the invention relates to a power and free conveyor system comprising a power or conveyor track 20 and a free or carrier track 21, herein shown as two tubular sections, one mounted within the other. A chain conveyor 22 having rollers thereon is movable along the carrier track 20. A plurality of carriers 23 are movable along the carrier track 21.

Each carrier 23 comprises a leading trolley 24 and a trailing trolley 25, each of which has spaced rollers 26, 27 that engage the carrier track 21. A pusher 28 is provided on the trailing trolley 25 and is adapted to be engaged by a pusher dog 29 on the conveyor 22 to move the carrier along the carrier track. A holdback dog 30 is provided in advance of each pusher dog 29 and serves the function of controlling the movement of the carrier since the pusher 28 is normally positioned between the holdback dog 30 and pusher dog 29. A plurality of holdback and pusher dogs 30, 29 are provided at longitudinally spaced points along the conveyor 22 and are pivoted about longitudinal axes extending in the path of movement of the conveyor, in accordance with conventional practice. If a carrier is stopped in any position, as the holdback dog 30 approaches, a cam surface thereon causes the holdback dog to be deflected by the pusher 28 bringing the pusher dog 29 into engagement with the pusher 28 so that the carrier is then advanced along the track by the conveyor.

Such a construction of power and free conveyor systems is old and well known, for example, in U.S. Pat. Nos. 3,060,886, issued Oct. 30, 1962, and 3,094,943, issued June 25, 1963.

In accordance with the invention, the rear trolley comprises an upper body portion 31 on which wheels 26, 27 are mounted and a lower body portion 32 pivoted about a horizontal axes to the upper body portion by a pin 33. A tie bar 35, in the form of an inverted U-shaped channel is pivoted on trolleys 24, 25 about vertical axes by bolt and nut assemblies 36. A rectangular paddle-shaped front bumper 37 is pivoted on a pin 38 extending between forwardly extending vertical mounting plates 39 on the front end of tie bar 35. Upstanding lever arms 40 are fixed on front bumper 37 and are movable therewith. A first rod assembly 41 is pivoted to the upper ends of arms 40.

Figure 2:
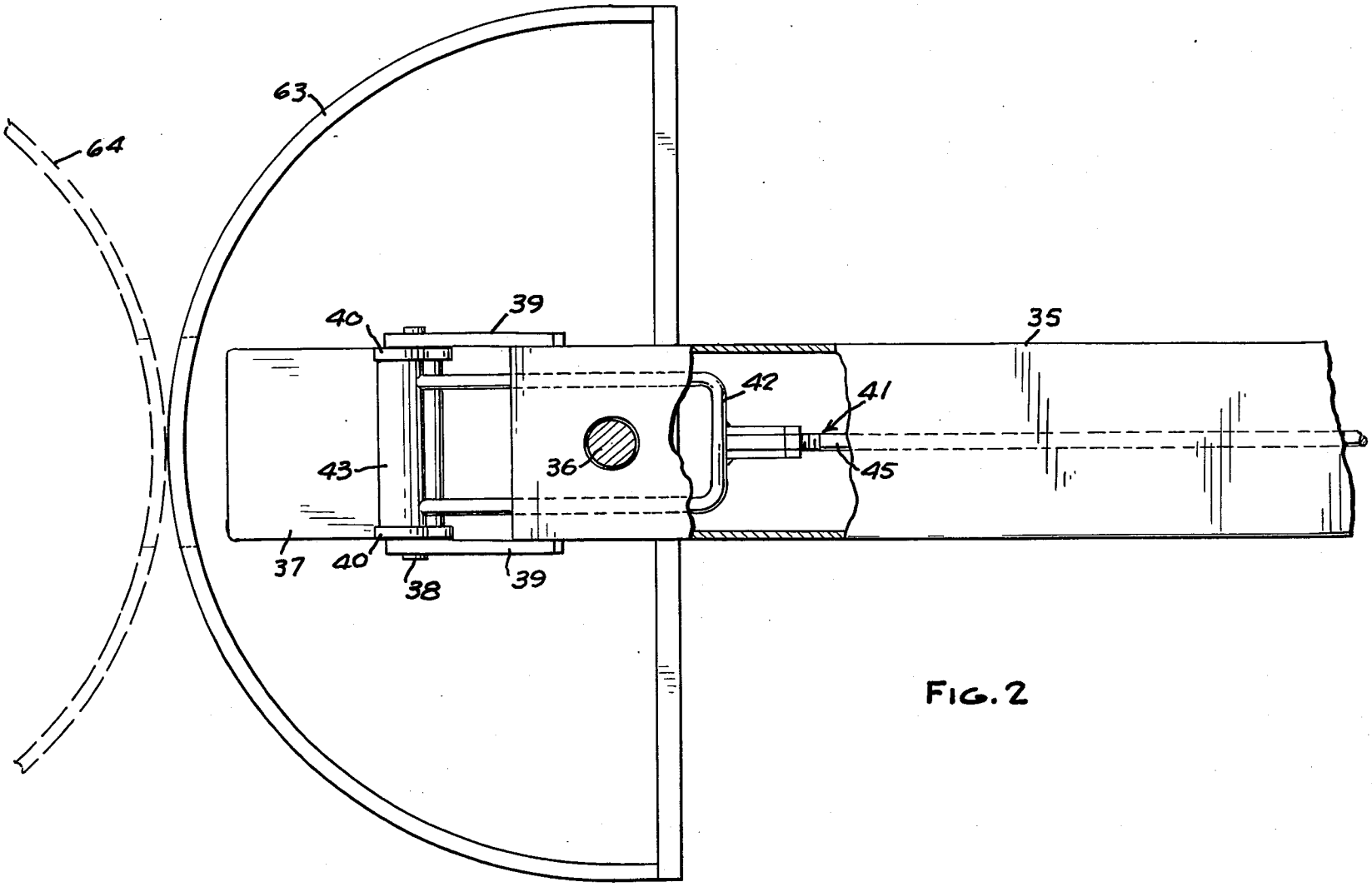
FIG. 2 is a part sectional view on an enlarged scale taken along the line 2—2 in FIG. 1.

The first rod assembly 41 comprises a front yoke 42 (FIG. 2) at the front end with a tube 43 fixed thereto, a rear yoke 44 (FIG. 3) at the rear end and a rod 45 fixed to the rear yoke 44 and adjustably threaded into the front yoke 42. A pivot shaft 46 is provided between arms 40 and extends through tube 43 on front yoke 42.

Figure 3:
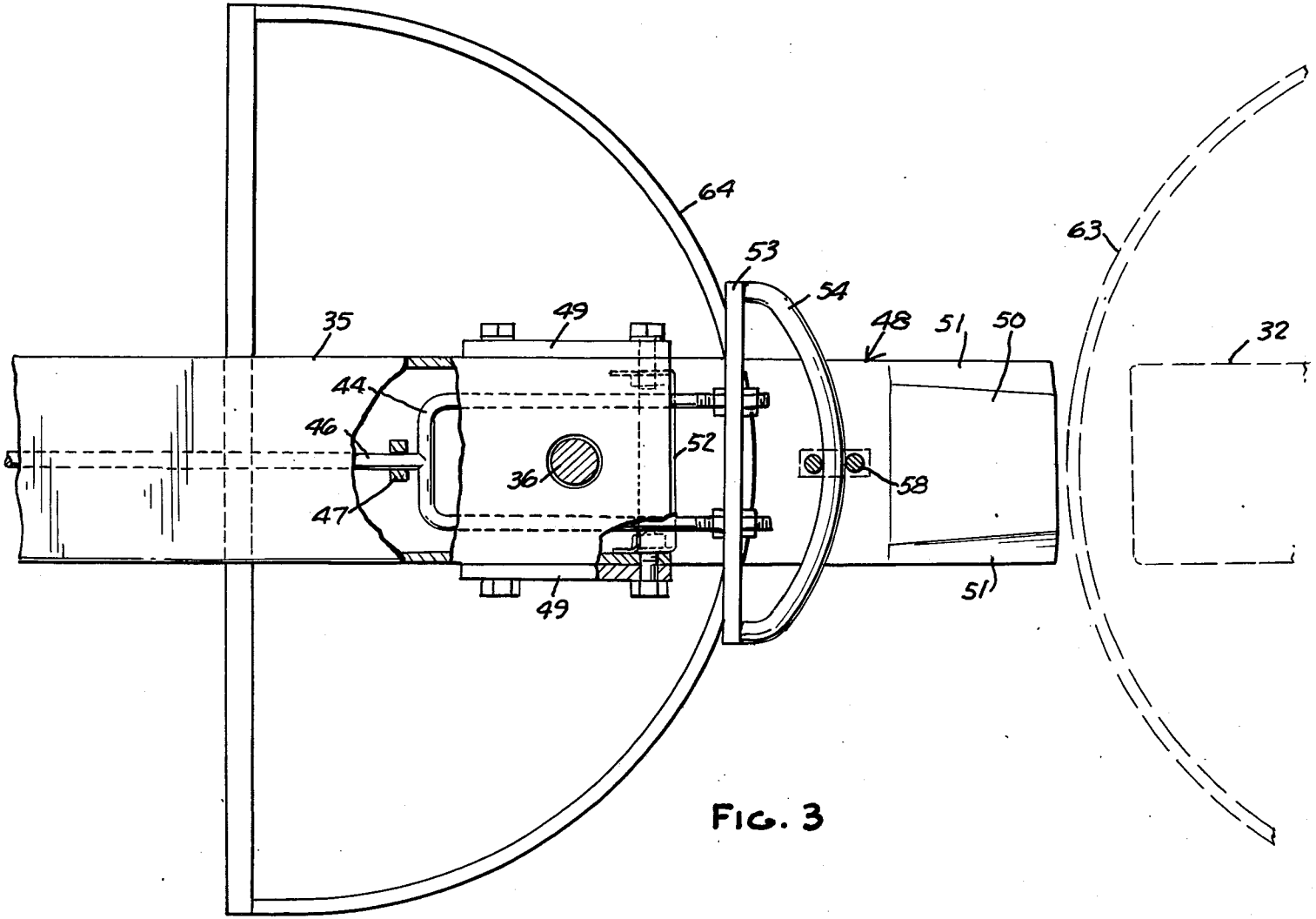
FIG. 3 is a part sectional view on an enlarged scale taken along the line 3—3 in FIG. 1.
Figure 4:
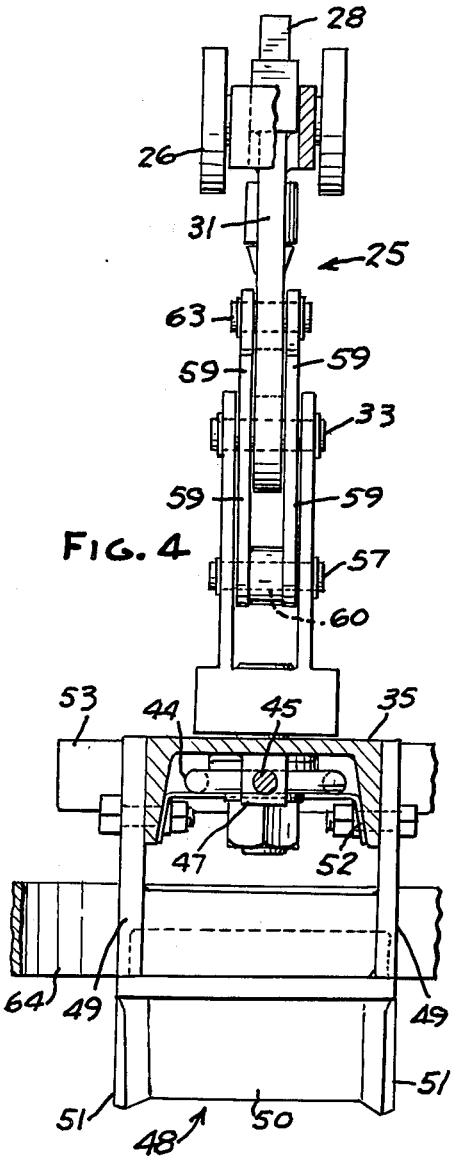
FIG. 4 is a fragmentary sectional view on an enlarged scale taken along the line 4—4 in FIG. 5.
Figure 5:
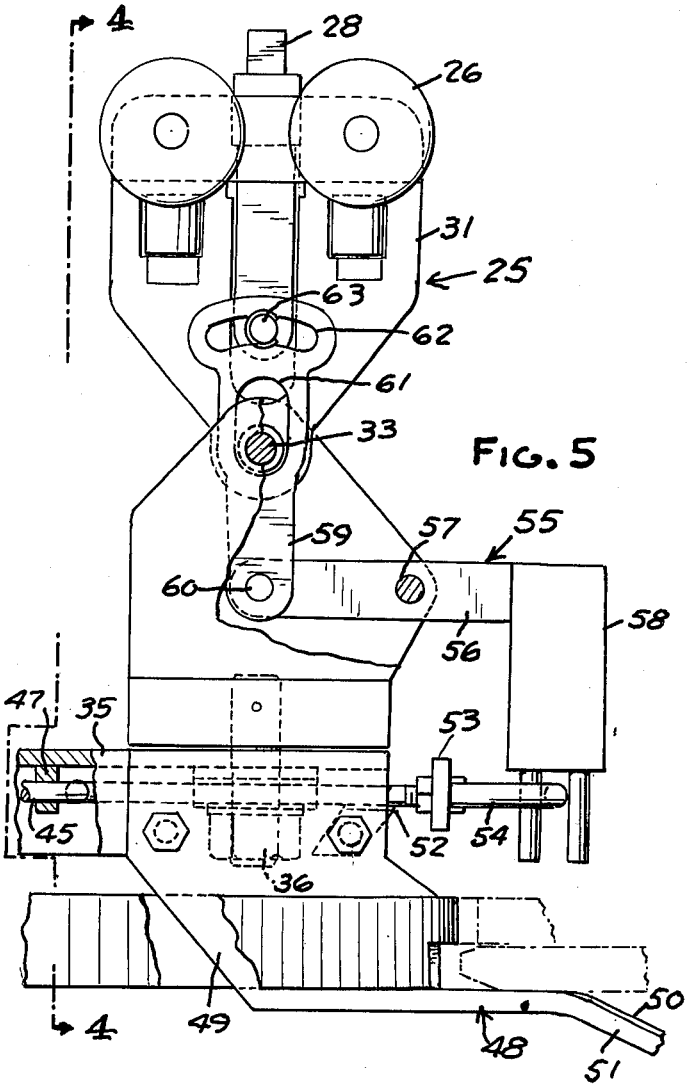
FIG. 5 is a part sectional side elevational view of a portion of the system shown in FIG. 1, parts being broken away.

As shown in FIGS. 3–5, the rear end of the rod 45 extends through a guide 47 fixed on the underside of tie bar 35.

A rear fixed bumper 48 is mounted on vertical plates 49 fixed on the rear of tie bar 35 and includes an inclined rearwardly extending paddle like member 50 having inclined longitudinal edges 51.

Figure 6:
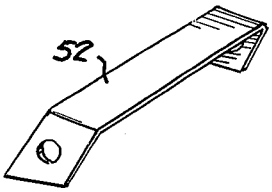
FIG. 6 is a perspective view of the part shown in FIG. 5.

Rear yoke 44 is guided by a support bracket 52 (FIG. 6) mounted between plates 49 (FIG. 4).

The rear ends of rear yoke 44 are fixed to a plate 53 that supports a curved rod 54, the curvature of which lies in a generally horizontal plane. An L-shaped actuator 55 has an upper arm 56, which is pivoted to the body portion 32 of trolley 25 at 57. Actuator 55 further includes a vertical arm 58, the lower end of which is bifurcated to engage curved rod 54.

Figure 7:
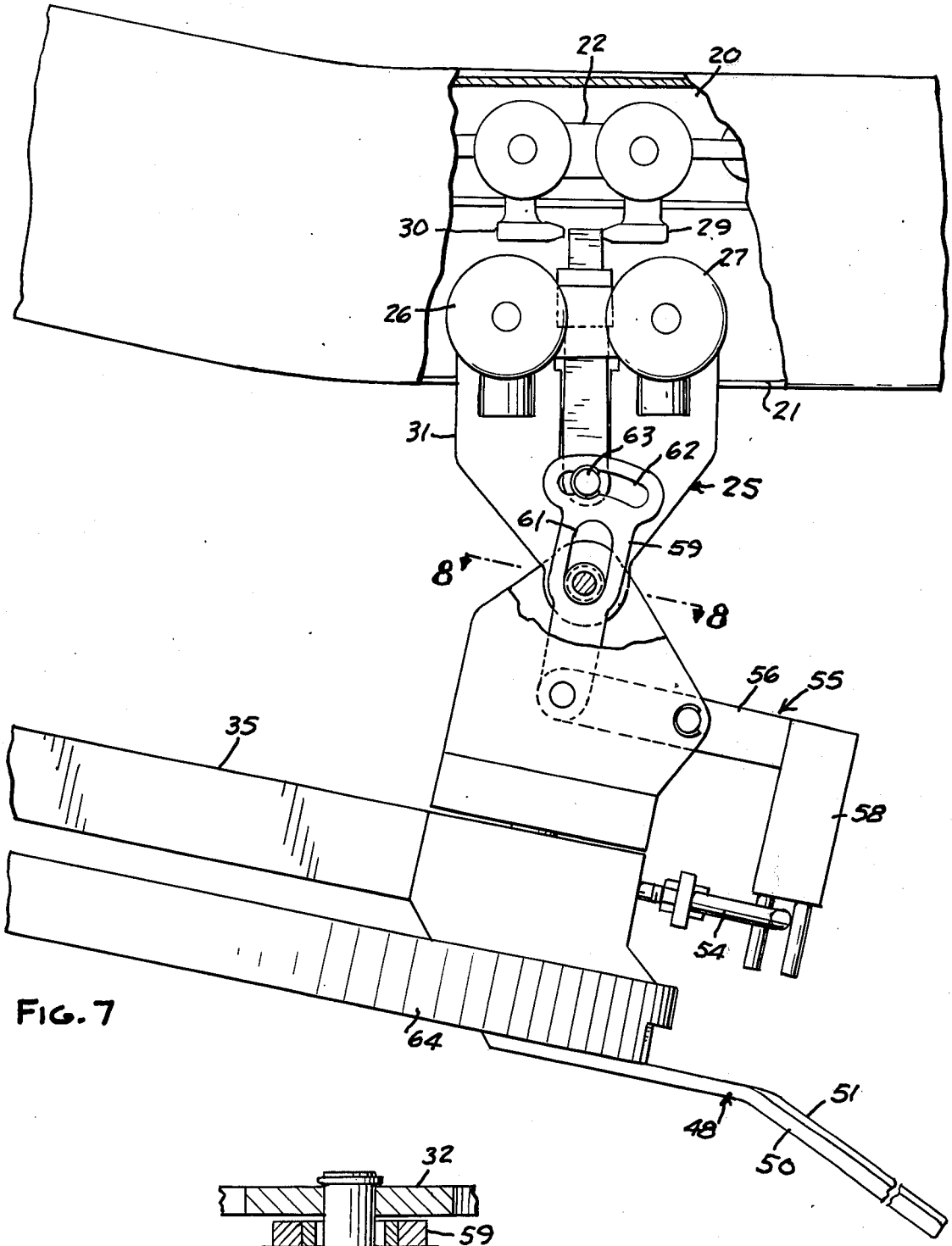
FIG. 7 is a sectional view similar to FIG. 5 showing the parts in a different operative position.
Figure 8:
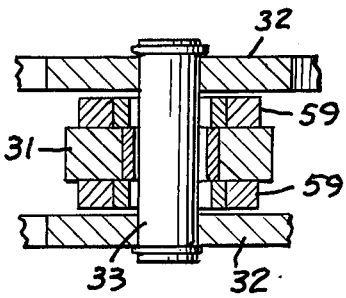
FIG. 8 is a fragmentary sectional view on an enlarged scale taken along the line 8—8 in FIG. 7.

A pair of acutator links 59 are pivoted to the free end of arm 56 by a pin 60. The upper ends of actuator links 59 are formed with a vertical slot 61 and an arcuate slot 62. The center of curvature of each slot 62 lies along a vertical axis within the slot 61. Pusher 28 includes ears 63 at its lower end which extend into slots 62. Pin 33, which pivots body portions 31, 32 to another, extends through slot 61. By this arrangement the position of pusher is not affected by relative angular movement between the trolleys and the tie bar caused by vertical curvature in the tracks (FIGS. 7, 8).

In operation, the carriers are moved along by entrapment of the pusher 28 between pusher and holdback dogs 29, 30. When the carrier encounters an obstacle or a preceding carrier, the bumper 37 pivots upwardly moving pusher rod assembly 41 rearwardly to pivot actuator 55, drawing the pusher 28 out of engagement with the pusher dog 29, thereby stopping the carrier.

Front bumper 37 and the lower arm 58 of actuator 55 are provided with weights which tend to return the pusher 28 to its normal operating position. The weights also function to prevent inadvertent lowering of pusher 28.

Figure 9:
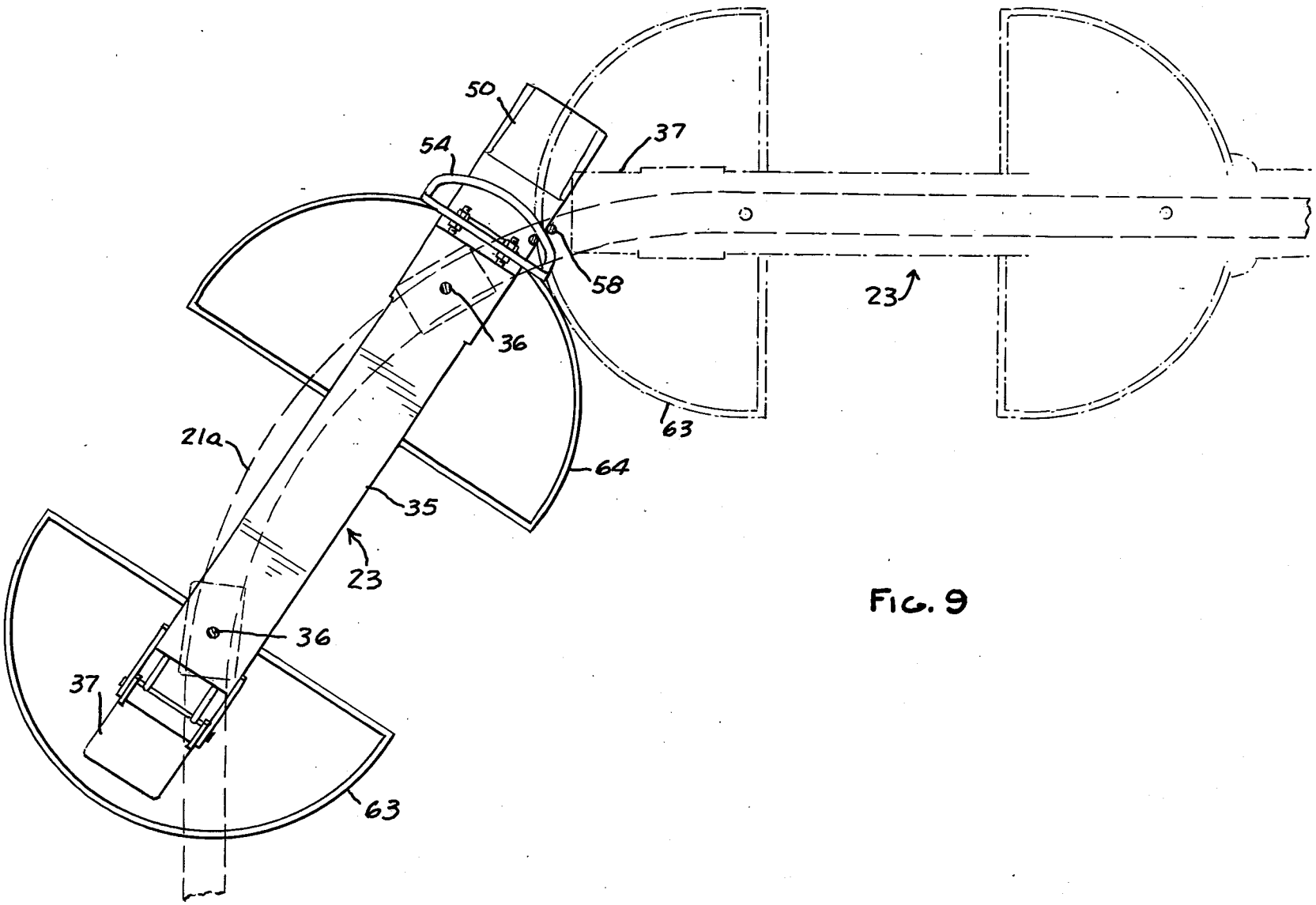
FIG. 9 is a partly diagrammatic plan view of a different portion of the system.

In addition, curved front and rear bumpers 63, 64, which are semicircular in extent function to permit gravity movement through a curve without accumulation. (FIG. 9). One carrier can push another through a gravity track portion 21*a* whereas there is no power conveyor 22 without inadvertent accumulation. The front edge of front movable bumper 37 extends into a notch 65 so that the fixed bumpers 63, 64 do not interfere with normal accumulation in a power and free conveyor situation.

Since the tie bar 35 is pivoted to the trolley bodies 24, 25 about vertical axes, the carrier can readily move about horizontal curves in the track as shown in FIG. 9. In addition, the carrier can readily move about vertical curves since body portions 31, 32 are pivoted to one another about horizontal pin 33 and pin 63 can articulate without vertical movement of pusher 28, as shown in FIG. 7.

I claim:

1. In a conveyor system, the combination comprising
a conveyor track,
a conveyor movable along said track,
a free track,
a plurality of carriers movable along the free track,
said conveyor having longitudinally spaced pusher and holdback dogs mounted thereon,
each said carrier comprising spaced trolleys and means interconnecting said trolleys,
a trailing trolley having a pusher movably mounted thereon for movement into and out of the path of the pusher and holdback dogs,
a bumper,
said bumper being movably mounted on the leading portion of said carrier and adapted to engage a preceding carrier or an obstacle,
and means interconnecting said bumper and said retractable pusher and operable upon engagement of the bumper with the preceding carrier or obstacle to move said pusher out of the path of said pusher and holdback dogs,
said last-mentioned means comprising actuator means movably mounted on said trolley,
means interconnecting said actuator means and said pusher,
and means interconnecting said bumper and said actuator,
said actuator means being pivoted to said trolley about a horizontal axis,
said rear trolley comprising an upper body portion and a lower body portion pivoted to one another,
said pusher being movably mounted in said upper body portion,
said actuator means being pivoted on said lower body portion.

2. The combination set forth in claim 1 wherein said means interconnecting said actuator means and said pusher comprises means permitting limited pivotal movement about a horizontal axis.

3. The combination set forth in claim 2 wherein said last-mentioned means comprises an arcuate slot in one of said pusher and said actuator means and engaging means on the other of said pusher and actuator means engaging said slot.

4. The combination set forth in claim 3 wherein said actuator includes an upper arm pivoted to said lower body portion, an actuator link pivoted to said upper arm, said arcuate slot being in said actuator link, said engaging means being on said pusher.

5. The combination set forth in claim 4 wherein said pivot of said upper and lower body portions extends through a slot in said actuator link.

6. The combination set forth in claim 4 wherein said actuator means includes an intermediate arm fixed to said upper arm, a lower arm fixed to said intermediate arm, said means interconnecting said actuator and said bumper engaging the free end of said lower arm.

7. The combination set forth in claim 4 wherein said actuator means includes a vertical arm fixed to said upper arm,
said means interconnecting said actuator and said bumper comprising a horizontally curved rod movable by said bumper, said vertical arm being bifurcated and engaging said curved rod.

8. The combination set forth in claim 1 wherein said means interconnecting said actuator means and said pusher comprises means permitting limited pivotal movement of said lower body portion relative to said upper body portion without affecting the position of said pusher.

9. In a conveyor system, the combination comprising
a conveyor track, a conveyor movable along said track,
a free track,
a plurality of carriers movable along the free track,
said conveyor having longitudinally spaced pusher and holdback dogs mounted thereon and pivoted about horizontal longitudinally extending axes,
each said carrier comprising spaced trolleys and means interconnecting said trolleys,
a trailing trolley,
a pusher,
means for movably mounting said pusher on said trolley for vertical movement into and out of the path of the pusher and holdback dogs,
a bumper,
said bumper being movably mounted on a leading portion of said carrier at the front end thereof and adapted to engage a preceding carrier or an obstacle,
and means interconnecting said bumper and said retractable pusher and operable upon engagement of the bumper with the preceding carrier or obstacle to move said pusher out of the path of said pusher and holdback dogs,
said last-mentioned means comprising actuator means movably mounted on said trolley,
means interconnecting said actuator means and said pusher,
and means interconnecting said bumper and said actuator,
said actuator means being pivoted to said trolley about a horizontal axis,
said rear trolley comprising an upper body portion and a lower body portion pivoted to one another,
said pusher being movably mounted in said upper body portion,
said actuator means being pivoted on said lower body portion.

10. The combination set forth in claim 9 wherein said means interconnecting said actuator means and said pusher comprises means permitting limited pivotal movement about a horizontal axis.

11. The combination set forth in claim 10 wherein said last-mentioned means comprises an arcuate slot in one of said pusher and said actuator means and engaging means on the other of said pusher and actuator means engaging said slot.

12. The combination set forth in claim 11 wherein said actuator includes an upper arm pivoted to said lower body portion, an actuator link pivoted to said upper arm, said arcuate slot being in said actuator link, said engaging means being on said pusher.

13. The combination set forth in claim 12 wherein said pivot of said upper and lower body portion extends through a slot in said actuator link.

14. The combination set forth in claim 12 wherein said actuator means includes an intermediate arm fixed to said upper arm, a lower arm fixed to said intermediate arm, said means interconnecting said actuator and said bumper engaging the free end of said lower arm.

15. The combination set forth in claim 12 wherein said actuator means includes a vertical arm fixed to said upper arm,
said means interconnecting said actuator and said bumper comprising a horizontally curved rod movable by said bumper, said vertical arm being bifurcated and engaging said curved rod.

16. The combination set forth in claim 9 wherein said means interconnecting said actuator means and said pusher comprises means permitting limited pivotal movement of said lower body portion relative to said upper body portion without affecting the position of said pusher.

17. A carrier comprising spaced trolleys and means interconnecting said trolleys a conveyor having longitudinally spaced pusher and holdback dogs mounted thereon,
a trailing trolley having a pusher movably mounted thereon for movement into and out of the path of the pusher and holdback dogs on the conveyor,
a bumper,
said bumper being movably mounted on the leading portion of said carrier and adapted to engage a preceding carrier or an obstacle,
and means interconnecting said bumper and said retractable pusher and operable upon engagement of the bumper with the preceding carrier or obstacle to move said pusher out of the path of said pusher and holdback dogs,
said last-mentioned means comprising actuator means movably mounted on said trolley,
means interconnecting said actuator means and said pusher,
and means interconnecting said bumper and said actuator,
said actuator means being pivoted to said trolley about a horizontal axis,
said rear trolley comprising an upper body portion and a lower body portion pivoted to one another,
said pusher being movably mounted in said upper body portion,
said actuator means being pivoted on said lower body portion.

18. The combination set forth in claim 17 wherein said means interconnecting said actuator means and said pusher comprises means permitting limited pivotal movement about a horizontal axis.

19. The combination set forth in claim 18 wherein said last-mentioned means comprises an arcuate slot in one of said pusher and said actuator means and engaging means on the other of said pusher and actuator means engaging said slot.

20. The combination set forth in claim 19 wherein said actuator includes an upper arm pivoted to said lower body portion, an actuator link pivoted to said upper arm, said arcuate slot being in said actuator link, said engaging means being on said pusher.

21. The combination set forth in claim 20 wherein said pivot of said upper and lower body portion extends through a slot in said actuator link.

22. The combination set forth in claim 21 wherein said actuator means includes an intermediate arm fixed to said upper arm, a lower arm fixed to said intermediate arm, said means interconnecting said actuator and said bumper engaging the free end of said lower arm.

23. The combination set forth in claim 21 wherein said actuator means includes a vertical arm fixed to said upper arm,
said means interconnecting said actuator and said bumper comprising a horizontally curved rod movable by said bumper, said vertical arm being bifurcated and engaging said curved rod.

24. The combination set forth in claim 17 wherein said means interconnecting said actuator means and said pusher comprises means permitting limited pivotal movement of said lower body portion relative to said upper body portion without affecting the position of said pusher.

* * * * *